US006843689B2

(12) United States Patent
Coniff

(10) Patent No.: US 6,843,689 B2
(45) Date of Patent: Jan. 18, 2005

(54) VIDEO CAMERA INTERFACE ADAPTER

(75) Inventor: Michael R. Coniff, South Hackensack, NJ (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/442,649

(22) Filed: May 20, 2003

(65) Prior Publication Data

US 2004/0235355 A1 Nov. 25, 2004

(51) Int. Cl.[7] ..... H01R 25/00
(52) U.S. Cl. ..... 439/638; 710/300
(58) Field of Search ..... 439/638–639, 439/620, 676, 76.1, 540.1, 955; 710/129, 131, 310, 300, 320, 324, 330

(56) References Cited

U.S. PATENT DOCUMENTS 5,043,696 A * 8/1991 Wang ..... 338/220
5,807,140 A * 9/1998 Hopkins ..... 439/638
6,321,340 B1 * 11/2001 Shin et al. ..... 713/310
6,558,201 B1 * 5/2003 Begley et al. ..... 439/638
6,671,764 B2 * 12/2003 Martin ..... 710/301

* cited by examiner

*Primary Examiner*—Gary Paumen
*Assistant Examiner*—Edwin A. Leon
(74) *Attorney, Agent, or Firm*—Stoel Rives LLP

(57) ABSTRACT

An interface adapter (32, 46, 48, 52, 82, 90) is connectable to a video camera (10) for example in security or surveillance applications. The adapter (32, etc.) conveniently provides interfacing for transmission of video signals generated by the camera, employing any one or more interfaces or transmission media, such as fiber-optic, radio frequency (RF), internet protocol (IP), wireless, twisted-pair (UTP), etc. By using the adapter, a single camera model having one native output transmission connector (14) can be deployed for a variety of applications that may require various other transmission media or connections (34, 36, 50, 92). The adapter makes the camera immediately ready for installation and connection to any desired transmission media without time-consuming wiring of external or standalone transmitters or transceivers. And the adapter preferably conforms to the camera enclosure for a clean, unitary appearance of the combined apparatus (FIG. 3, FIG. 11).

14 Claims, 5 Drawing Sheets

FIG. 6
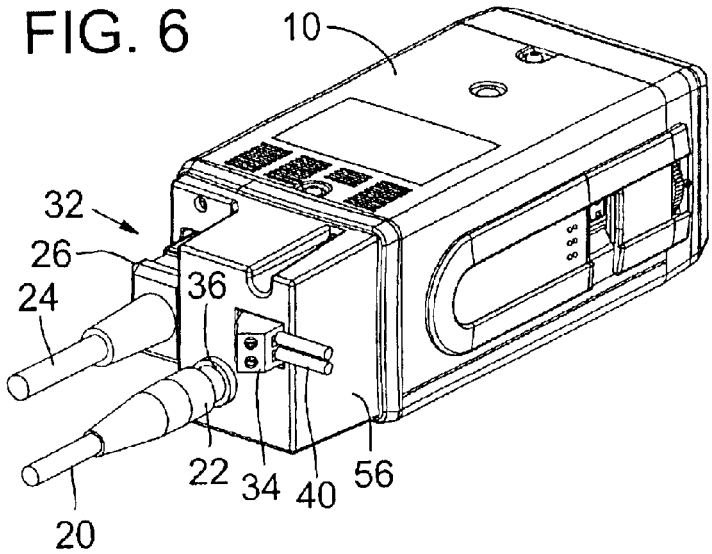
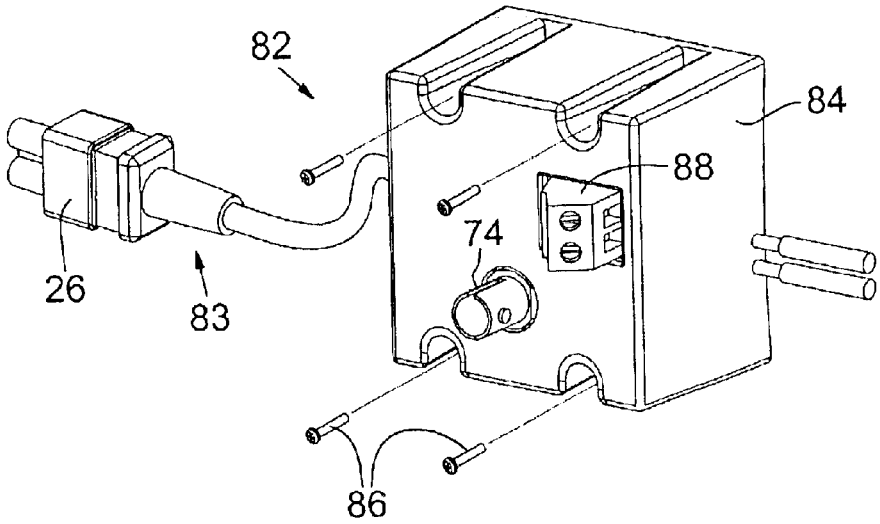
FIG. 7

VIDEO CAMERA INTERFACE ADAPTER

COPYRIGHT NOTICE

© 2003 General Electric Company. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR § 1.71(d).

TECHNICAL FIELD

The invention pertains to video cameras and related equipment and, more specifically, is directed to interfacing a video camera to transmit video signals over various signal transmission media.

BACKGROUND OF THE INVENTION

Closed-circuit television or CCTV is widely used for video security/surveillance, video distribution, distance learning and other applications. Frequently, remote CCTV cameras, for example those mounted in a warehouse or overlooking a parking lot, are wired to a monitoring station which may comprise one or more monitors for watching the video (and sometimes audio) stream, and/or recording equipment (DVR—digital video recording—for example) for capturing and storing the surveillance signals.

Various transmission methods and media are known for transmitting the video signals (which may include audio signals) from the camera to a remote monitor and/or recording system. The different transmission protocols and media offer choices to enable a user to trade off cost, interference immunity, signal loss (i.e., maximum distance), etc. Known transmission media include: coaxial cable (most commonly used), fiber-optic, radio frequency (RF), internet protocol (IP) (which may employ computer network wiring such at CAT-5), wireless, twisted-pair (UTP), etc. UTP would include ordinary telephone wiring, for example of the type terminated with RJ-11 or RJ-45 connectors.

Each of these media requires its own electrical/mechanical connectors. Examples of such connectors include BNC; RJ-11; RJ-45; Fiber-type; RCA etc. and terminals for twisted pair (UTP), coaxial cable, and others. Wireless systems or course have no physical connection between the transmitter and receiver nodes, but they require connections to input signals to the transmitter and, conversely, to output signals from the receiver device. The appropriate connector for a particular application may or may not be built into the camera at the time of manufacture.

In addition, various transmitters, receivers and transceivers are known for conveying video signals. These may be passive (non-amplified) or active, the latter enabling transmission over greater distances. For example, a typical known passive video transmitter will transmit full-motion video up to 1,000 feet over UTP, while the same transmitter used in conjunction with an amplified receiver is reported to operate up to 3,000 feet.

In general, a video surveillance camera has a video output connector or jack, or perhaps two different ones, built into the product. We will refer to such a connector as the "native" connector; the one already on the camera as purchased. A BNC connector is a common native connector. This works fine for connection to transmitters or cables that have a BNC input jack, but is incompatible with other connectors such as RJ-11 or RCA which may be needed for the transmission media (wiring) at hand. Installation of the camera in such applications requires the installer to deploy some kind of adapter, and to install the adapter between the camera and the transmission medium. Installing the adapter requires both electrical connection and mechanical mounting. This kind of activity adds to the time and expense of video camera installation, especially as it may be required at every camera throughout a large facility. Examples are shown in drawing FIGS. 1A and 1B further described below.

The need remains therefore for a fast, simple and convenient way to interface a video camera to a transmission media that requires a connection different from the "native" connector or connector(s) built into the camera at manufacture.

SUMMARY OF THE INVENTION

One aspect of the invention is directed to the concept of an interface adapter for mounting to a video camera, primarily for transmitting video signals originating in the camera to another location. The adapter can also provide other functions such as power distribution. Installation of the camera is simplified in many cases because the adapter provides the appropriate connector(s) for the application at hand. The video camera has at least one built-in or "native" connector typically on the back panel, to output the video signals. An adapter according to the invention includes input means arranged for electrical connection to the native connector to receive the video signals originating in the camera while the adapter is connected to the camera. The adapter further provides output means for conveying the video signals from the adapter to a transmission medium; for example, twisted pair, fiber optic or other cabling, or wireless transmission.

Accordingly, the output means is electrically coupled to the input means to receive the video signals originating in the camera. By the term "coupled" we mean a direct electrical connection, or an indirect connection that involves a transmitter, filter, amplifier, A/D converter or other electronic circuitry that takes the video signals generated by the camera as its input. In a presently preferred embodiment, the output means includes a terminal block or other connector to provide mechanical and electrical connection to a corresponding wired transmission medium such as UTP. The output means generally includes at least one of a twisted-pair connector, a BNC connector, an RCA connector, a USB connector or other analog or digital data connection. The output means can be wireless, in which case the electronic circuitry mentioned above would comprise a wireless transmitter. The output means could be fiber optic. These are merely examples and not listed by way of limitation. Multiple output connectors can be provided on one adapter. For example, a first connector can be provided for signal transmission and a second connector for temporary connection to a monitor for testing.

Preferably, the adapter is built into a substantially rigid housing that is generally shaped so as to cover at least a portion of the back panel of the camera that includes the native connector. The interface adapter assembly also should be mechanically compatible with the camera so as to enable removably connecting the adapter to the camera without modifying the camera. For example, the screw holes typically used to attach the back panel to the camera could be used to receive screws for mounting the adapter.

As a matter of design choice, the adapter can have any desired size or shape, but preferably it generally conforms to the configuration of the target camera. In other words, the adapter should look like a part of, or extension of, the camera when installed. This can be done, for example, by sizing the adapter to overlay a portion of the camera, with smooth transitions, while minimizing protrusions extending from the camera. So, for example, an external surface of the adapter housing would preferably parallel an external surface of the camera housing. These design principles will become more apparent in view of the various examples shown in the drawing figures and described in detail below.

Additional aspects and advantages of this invention will be apparent from the following detailed description of preferred embodiments, which proceeds with reference to the accompanying drawings.

BRIEF DESCRIPTION OF THE DRAWINGS

FIG. 6 is another perspective view of the apparatus of FIG. 3.

FIG. 7 is a perspective view of an alternative embodiment of an interface adapter for fiber optic transmission.

DETAILED DESCRIPTION OF PREFERRED EMBODIMENTS

Figure 1:
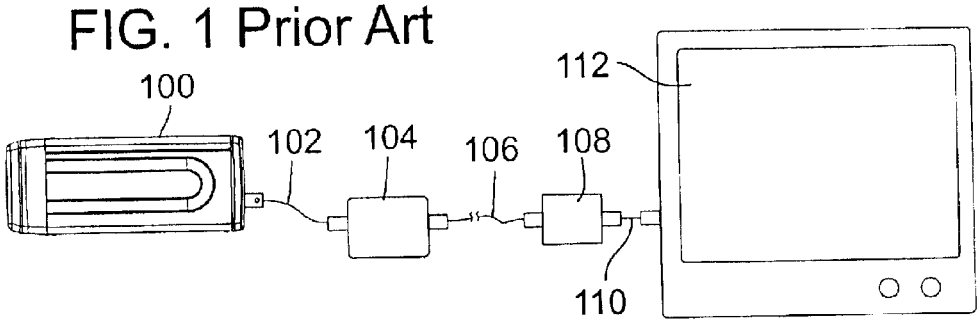
FIG. 1 Prior Art
FIG. 1 is a simplified diagram illustrating a prior art video system for transmitting video signals from a video camera to a remote location.

FIG. 1 is a simplified diagram illustrating a prior art video system. Here, a video camera 100 has a video output connector (not detailed) to provide video output signals. A cable 102 is connected between the video output connector on the camera and a transmitter device 104. An example of such a transmitter is model NV-314A available from Network Video Technologies ("NVT"), Redwood City, Calif. In a typical installation, the transceiver 104 is mounted near the camera. The transceiver provides appropriate interfacing for transmitting the video output signals over an unshielded twisted pair of wires ("UTP") 106 with low signal loss. The transmitter can be passive (unpowered) or powered, in the latter case providing for transmission over greater distances, e.g., up to 3,000 ft. Although UTP cable is itself inexpensive and easy to use, providing connectors such as RJ-45 on the ends of the cable increases installation costs.

A second transceiver 108, compatible with or even identical to the first transceiver 104, is provided at the far end (away from the camera) for interfacing the UTP 106 to a coax cable 110 which, in turn, is connected to a video monitor 112 and/or other equipment such as a video motion detector. (Video signals, in this example and in general, can include audio content as well.)

Figure 2:
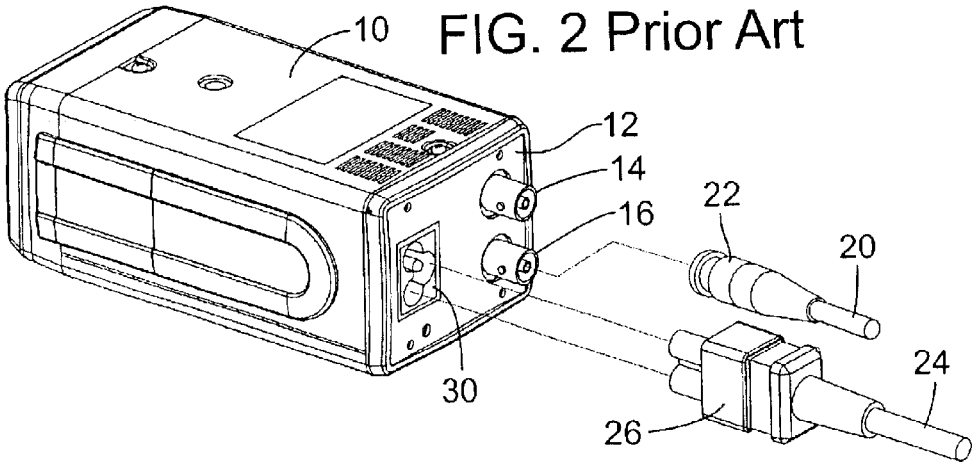
FIG. 2 Prior Art
FIG. 2 is a perspective view of a video camera and cable connections (exploded) representative of the prior art.

FIG. 2 is a perspective view of a video camera 10 seen generally from the rear. Camera 10 has a back panel 12 on which one or more connectors are fixed for establishing electrical connections to the camera. While the number and types of connectors varies, FIG. 2 illustrates a common configuration that includes a first BNC connector 14 and a second BNC connector 16, each used for transmitting video signals from the camera to a remote location such as a security monitoring station or recorder. It is also known to send control signals "up-the-coax" i.e., to the camera over the same cable, for controlling camera functions remotely. We refer hereinafter to connectors that are built into the camera (like 14,16) as "native" connectors.

In FIG. 2, a first cable 20 (for example, a coax cable) has a male BNC type connector 22 for mating to native connector 16 on the camera back panel 12. Another cable 24 has a connector 26 for mating to a corresponding connector 30 on the back panel 12 to power the camera, usually supplying 12 or 24 VDC from an external power supply. Typically, coax cable 20 is connected to a transceiver, just as coax cable 102 is connected to transceiver 104 in FIG. 1A, described above.

Figure 3:
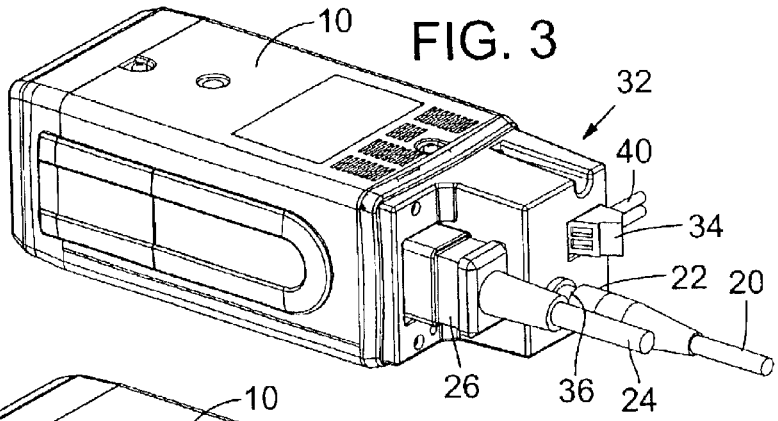
FIG. 3 is a perspective view of a video camera with attached interface adapter and cabling in accordance with a first embodiment of the present invention for fiber optic transmission.

Referring now to FIG. 3, we introduce a new video camera interface adapter assembly. In one embodiment, illustrated in FIG. 3, the interface adapter 32 is removably attached to the camera 10 generally overlying the back panel 12. The peripheral edge of the adapter facing the camera (17 in FIG. 4) is sized and shaped to generally conform to the periphery of the back of the camera so as to appear, when installed (as in this figure), to be a part or extension of the camera. The interface adapter assembly 32 in this embodiment includes a terminal block 34 and a fiber optic connector 36. Power supply wiring 40 is shown installed into the terminal block 34 to power a fiber optic transmitter (or transceiver) in the adapter (not shown). FIG. 6 shows the apparatus of FIG. 3 from the right rear perspective.

Figure 4:
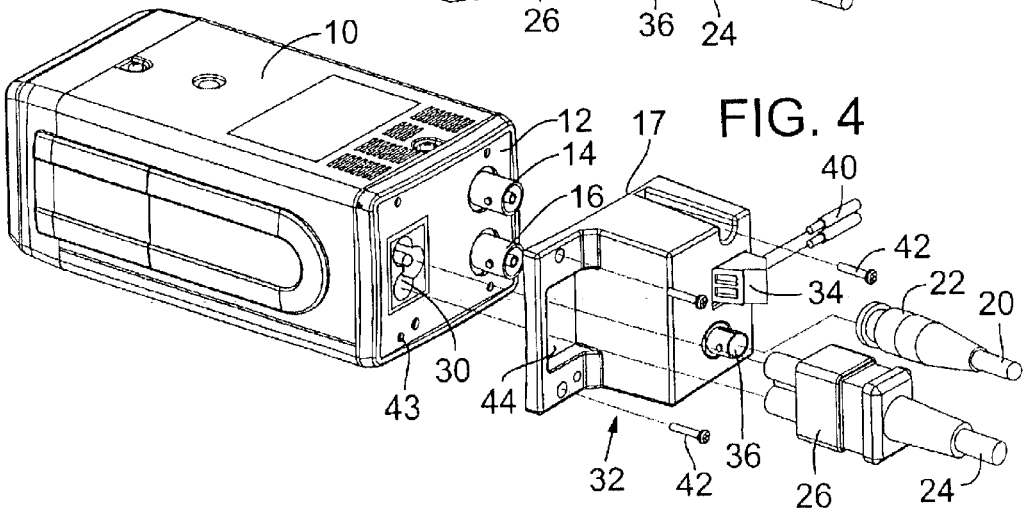
FIG. 4 is an exploded view of the apparatus of FIG. 3.

FIG. 4 shows the apparatus of FIG. 3 in exploded view. The adapter 32 is removably attached to the camera with screws 42 or the like so that the adapter generally covers the back panel 12. The screws 42 pass through holes in the adapter and are received in mounting holes 43 normally provided in the camera back panel. The adapter in this embodiment forms ah aperture 44 arranged so that the camera power connector 30 is exposed and available for connection to cable 24 via mating connector 26. The adapter in this configuration thus does not affect the camera power connection.

Figure 8A:
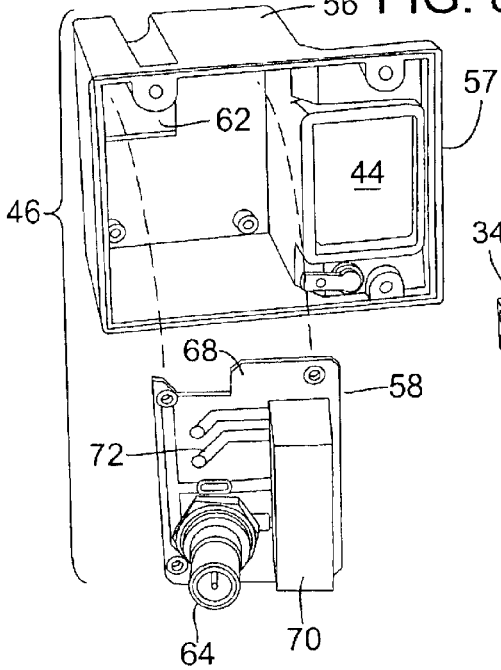
FIG. 8A is a perspective, exploded view of a second embodiment interface adapter for UTP transmission.
Figure 8B:
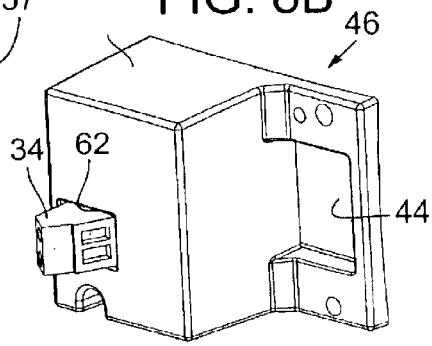
FIG. 8B is a perspective view of the adapter of FIG. 8A assembled.
Figure 9:
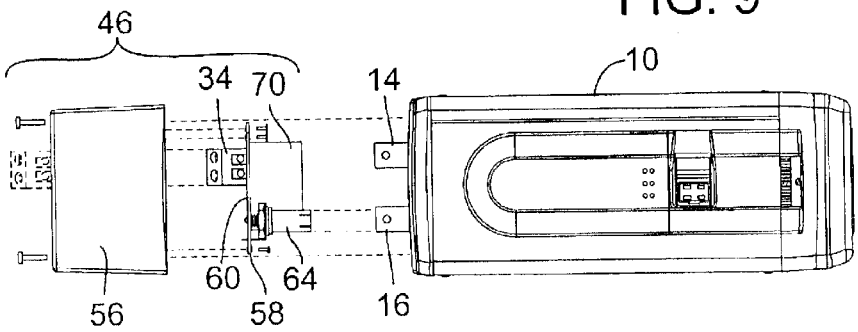
FIG. 9 is a side view, exploded, of a video camera and interface adapter of FIGS. 8A and 8B.
Figure 10A:
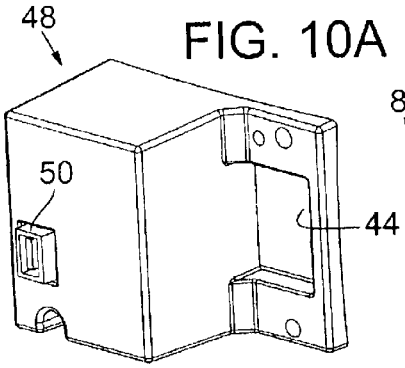
FIG. 10A illustrates another embodiment of an interface adapter in accordance with the present invention.

The interface adapter (32 being just one example) can have any of various configurations. To illustrate, FIGS. 3,4,5,6 and 7 show an adapter 32 with a terminal block 34 and fiber optic connector 36, as noted above. In such configurations, power is supplied to the terminal block to power the fiber optic circuits. FIGS. 8A, 8B and 9 illustrate an alternative adapter 46 which has only a terminal block 34 for UTP output connection. FIG. 10A is a perspective view of an alternative adapter assembly 48 that includes a USB-type external connector 50 which could be used for a digital data connection. Multiple output connections can be implemented in a single adapter, again simplifying installation for many applications.

Figure 10B:
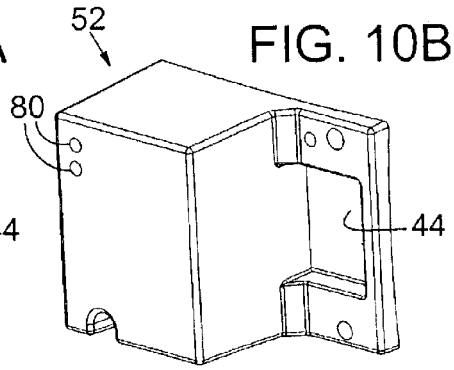
FIG. 10B illustrates another embodiment of an interface adapter in accordance with the present invention.

FIG. 10B illustrates another embodiment; an adapter assembly 52 that employs a wireless transceiver (not shown) for communicating video signals. Indicator lights 80 (LEDs) can be provided to indicate a present status of the wireless transceiver (for example, power and signal acquisition). Wireless transceiver circuits, for example IEEE 802.11 series, "WiFi" or Bluetooth, are known and commercially available from various vendors. Next we describe a UTP embodiment 46 in greater detail.

Adapter 46 is attachable to a camera as described earlier with regard to the adapter 32. Referring to FIG. 8A, adapter 46 comprises a housing 56 formed of any sturdy, rigid material such as a molded polymeric material. The housing provides mounting screw holes, for attaching the adapter to the camera, although other attaching means can be used as a matter of design choice. Preferably, the housing is sized and arranged to generally conform to the configuration of the back and/or any one or more sides of the camera to which it will be attached. For example, at least a portion of the perimeter edge 57 of the housing should fit closely along the camera perimeter so as to give the combination a unitary, tidy appearance when the adapter is installed. In one anticipated commercial embodiment called PlusPacks™, the adapter assembly extends only about 3.2 cm beyond the back panel, yet it eliminates the need for an external transmitter and associated wiring to convert BNC analog video to twisted pair output.

Referring now to FIGS. 8A and 8B, adapter 46 in a presently preferred embodiment further comprises a circuit board 58 mountable inside the housing 56, for example using screws. Referring now also to FIG. 9, the circuit board 58 includes the terminal block 34 securely mounted on the underside 60 of the circuit board, and located on the board so that the terminal block 34 extends through an aperture 62 provided in the housing 56 when the board 58 is mounted in the housing, as indicated by dashed lines in FIG. 8A and FIG. 9. In this embodiment, the terminal block is used to connect a pair of wires for UTP video signal transmission.

A connector 64 is securely mounted the top side 68 of circuit board 58. (The designations "underside" and "top side" here are arbitrary.) Connector 64 is located and aligned for mating engagement with a native connector on the camera back panel when the board 58 is mounted in the housing 56 and the adapter 46 is connected to the camera. FIG. 9 shows in side view how the connector 64 is aligned for engagement with native connector 16 on the camera. In one embodiment, connector 64 is a "push-in BNC" connector. It is compatible for "push-in" engagement with a standard BNC female connector (16) without the usual "push-and-turn" operation. Connector 64 thus couples video output signals from the camera to the adapter circuit board 58 when in use.

The interface adapter 46 in this example further includes a transmitter module 70 also mounted on the top side 68 of circuit board 58 although its location is a matter of design choice. Transmitter 70 provides suitable interfacing for transmitting video signals over wires connected to the terminal block 34, e.g., UTP transmission. Accordingly, the circuit board 58 includes conductors (traces) for electrically connecting the push-in BNC 64 to the transmitter 70 input terminals (not shown), and traces 72 (see FIG. 8A) for connecting the transmitter output terminals to the terminal block 34. Transmitters of this type are commercially available, one example being model NV-M11 from NVT. For other designs, the appropriate transmitter or transceiver, if any, or other circuitry such as a filter or amplifier, will be determined by the output transmission media, transmission distance, environment, and the like.

Figure 5:
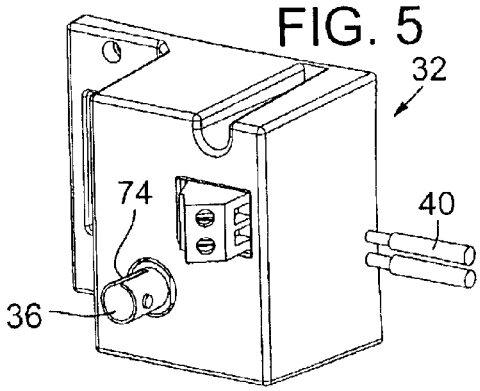
FIG. 5 is a perspective view of the interface adapter of FIGS. 3–4.

In the fiber optic embodiment of FIGS. 3 and 4, the adapter 32 is outwardly similar to adapter 46 as described, with the addition of the fiber optic output connector 36. And in that case, the terminal block is used to supply power rather than UTP output connections. The fiber connector 36 can be deployed by mounting it on the underside 60 of a circuit board-similar to board 58, and providing a suitable aperture 74 in the adapter housing, as best seen in FIG. 5. Circuit board 58 in that embodiment would further include traces for connecting the push-in BNC 64 to the fiber optic transmitter signal input terminals (not shown), and for connecting the transmitter output terminals to the output connector 36. Alternatively, a second push-in BNC connector (not shown) could be mounted on the top side of the board and aligned for engaging a second native connector 14 (see FIG. 9). Other types of connectors, for example, RCA, or S-video connectors or adapters can be deployed on the circuit board as appropriate to the native connector(s) of the target video camera.

Furthermore, any set of one or more desired output connectors can be implemented in the adapter; the appended illustrations shown only a few examples. In the example of FIG. 10A, a USB connector 50 would be mounted on the underside 60 of the circuit board of FIG. 9, in lieu of the terminal block, and necessary interface electronics provided. In the example of FIG. 10B, a wireless transceiver is provided, as noted. It too can be mounted on the circuit board described. The circuit board can be designed to provide power to various transceivers as needed. The power can be provided from a battery or external power source via the terminal block.

Another approach is illustrated by FIG. 7. The adapter assembly 82 of FIG. 7 is sized and shaped to cover substantially the entire back panel of the camera. Instead of providing an aperture for a power connection to the native power connector (30 in FIG. 4) as described earlier, this adapter includes a "pig tail" assembly 83 for connecting the adapter to the camera's native power connector before attaching the adapter 82 to the camera. Here, power is supplied for both the camera and the video signal transmission electronics from a terminal block 88. This embodiment can include a fiber optic output 74 or any of the wired or wireless transmission media described earlier. This design avoids multiple power connections.

Figure 11A:
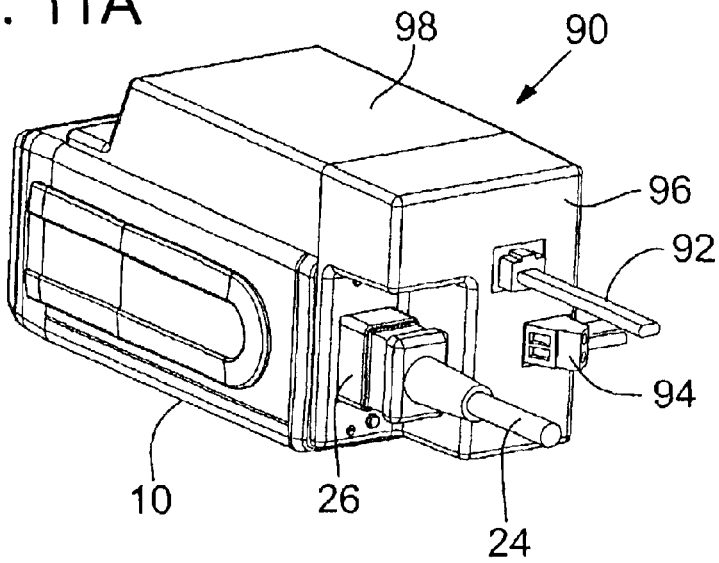
FIG. 11A is a perspective view of a video camera and attached interface adapter in accordance with another embodiment of the invention.
Figure 11B:
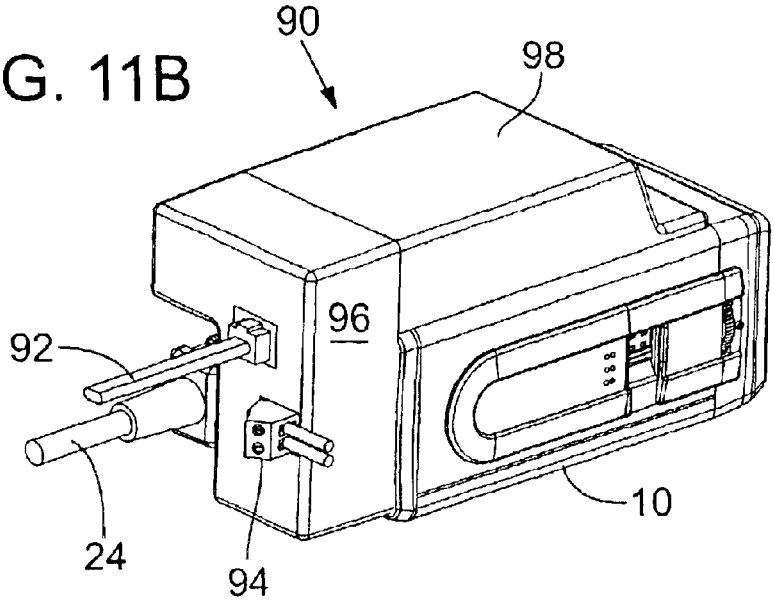
FIG. 11B is an alternative perspective view of the apparatus of FIG. 11A.

Referring now to FIGS. 11A and 11B, another example of an embodiment of the present invention is illustrated. Here, an alternative interface adapter 90 is shown attached to the video camera 10. Various input and output connections can be provided in the adapter as discussed above. For example, the drawing shows an RJ-45 receptacle 92 for IP connection and a terminal block 94 (which could serve as a UTP output or a power input). A conventional camera power input connector 26 is shown.

The interface adapter assembly 90 illustrates the concept of an adapter design that generally conforms to more than one face of the camera 10. Here, the adapter includes a rear section 96, similar to embodiments described above, and a top section 98 extending at least partially along the top side of the camera and having a width substantially equal to the width of the camera. Sections 96 and 98 are substantially contiguous, forming a smooth exterior surface, and are substantially contiguous or at least communicating with one another in the interior (the space generally between the camera and the adapter housing).

This type of configuration provides considerable additional space inside the adapter to house power supply and various interface circuitry as may be required. In general, the adapter can extend over any side or sides of the camera, part way or the full length of the camera. Preferably, it will cover at least a part of the back panel for engaging at least one native connector. Again, the adapter should generally comply with the camera shape and size, at least in part, for a neat appearance.

It will be obvious to those having skill in the art that many changes may be made to the details of the above-described embodiments without departing from the underlying principles of the invention. The scope of the present invention should, therefore, be determined only by the following claims.

What is claimed is:

1. An interface adapter for mounting to a target video camera for transmitting video signals originating in the camera, the camera having a first native connector to output the video signals, and the adapter comprising:

a substantially rigid housing;

a first connector mounted within the housing and arranged so as to establish electrical connection to the native connector to receive the video signals originating in the camera while the adapter is mounted to the camera;

a second connector mounted in the adapter and exposed outside the housing for connection to a transmission medium; and means in the adapter for coupling the output connector to the first connector to receive the video signals originating in the camera, wherein the target video camera has a back panel that includes the native connector and the housing is generally shaped so as to cover at least a portion of the back panel that includes the native connector.

2. An interface adapter according to claim 1 wherein the housing includes an aperture for making a power connection to the camera.

3. An interface adapter according to claim 1 wherein the second connector includes at least one of a twisted-pair terminal block, a BNC connector, an RCA connector, a USB connector and a fiber optic connector.

4. An interface adapter according to claim 1 wherein the second connector comprises a wireless transceiver.

5. An interface adapter according to claim 1 wherein:

the adapter includes a circuit board mounted within the housing;

the first connector is mounted to the circuit board at a selected location and aligned for mating engagement with the native connector on the camera to receive the video signals when the adapter is connected to the camera and the camera is in operation.

6. An interface adapter according to claim 5 and wherein the second connector is mounted to the circuit board in the adapter and extends outside of the housing for connection to the said transmission medium; and the second connector is electrically coupled to the first connector via the circuit board.

7. An interface adapter according to claim 5 and wherein the housing includes a first section configured to overlay at least a portion of the target video camera back panel, and a second section configured to overlay at least a portion of a side of the target camera.

8. An interface adapter according to claim 5 and wherein the first connector comprises a push-in BNC connector.

9. An interface adapter according to claim 8 and wherein the second connector is coupled to the first connector via a transmitter module mounted on the circuit board.

10. An interface adapter according to claim 8 including a terminal block to connect external power for powering video output interface electronics.

11. A method of wiring a target video camera for transmitting video output signals from the target video camera to a remote location, the method comprising:

providing an adapter mechanically compatible with the target video camera in that the adapter includes an input connector arranged for mating engagement with a native connector on the video camera while the adapter is attached to the video camera;

attaching the adapter to the video camera, including engaging the input connector with the native connector;

providing a desired output connector on the adapter, coupled to receive the video output signals from the native connector;

connecting the output connector to a corresponding transmission medium for transmitting the video output signals from the target video camera to the remote location;

wherein the adapter includes a rigid housing, and the housing has a predetermined shape that extends generally parallel to an external surface or back panel of the camera so that the adapter is substantially contiguous to the camera while attached thereto; and wherein the housing substantially overlies the back panel of the camera.

12. A method according to claim 11 including connecting an external power supply to the adapter, and in the adapter, providing power to the camera and providing video signal-output transmission power, both derived from the external power connection.

13. A method of wiring a target video camera for transmitting video output signals from the target video camera to a remote location, the method comprising:

providing an adapter mechanically compatible with the target video camera in that the adapter includes an input connector arranged for mating engagement with a native connector on the video camera while the adapter is attached to the video camera; wherein the adapter includes a rigid housing that substantially overlies the back panel of the camera, covering the native connector;

attaching the adapter to the video camera, including engaging the input connector with the native connector;

providing a desired output connector on the adapter, coupled to receive the video output signals from the native connector; and connecting the output connector to a corresponding transmission medium for transmitting the video output signals from the target video camera to the remote location.

14. A method of wiring a target video camera according to claim 13 wherein said connecting the output connector to a corresponding transmission medium includes providing a wireless transceiver for transmitting the video output signals from the target video camera to a remote location.

* * * * *